US009447685B2

(12) United States Patent
Kennedy et al.

(10) Patent No.: US 9,447,685 B2
(45) Date of Patent: Sep. 20, 2016

(54) MINE VENTILATION STRUCTURE AND A DECK PANEL FOR SUCH A STRUCTURE

(71) Applicant: Jack Kennedy Metal Products & Buildings, Inc., Taylorville, IL (US)

(72) Inventors: William R. Kennedy, Taylorville, IL (US); John M. Kennedy, Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 0 days.

(21) Appl. No.: 14/685,686

(22) Filed: Apr. 14, 2015

(65) Prior Publication Data

US 2015/0315911 A1 Nov. 5, 2015

Related U.S. Application Data

(60) Provisional application No. 61/987,743, filed on May 2, 2014.

(51) Int. Cl.

| | |
|---|---|
| ***E04F 11/16*** | (2006.01) |
| ***E21F 1/14*** | (2006.01) |
| ***E21F 1/16*** | (2006.01) |
| ***E21F 1/04*** | (2006.01) |

(52) U.S. Cl.
CPC . *E21F 1/14* (2013.01); *E21F 1/04* (2013.01); *E21F 1/16* (2013.01)

(58) Field of Classification Search
CPC ..... E21F 17/103; E21F 1/14; E04C 2/08; E04C 2/322; E04C 2/326
USPC ..... 52/650.3
See application file for complete search history.

(56) References Cited

U.S. PATENT DOCUMENTS

| | | | | |
|---|---|---|---|---|
| 1,871,618 | A | 8/1932 | Klopp | |
| 2,180,317 | A * | 11/1939 | Davis | E04B 5/40 52/223.1 |
| 2,670,060 | A * | 2/1954 | Fenske | B61D 17/10 404/19 |
| 2,729,064 | A * | 1/1956 | Kennedy | E21F 17/103 299/11 |
| 2,729,066 | A * | 1/1956 | Kennedy | E21F 1/14 138/105 |
| 2,955,687 | A * | 10/1960 | Seim | B62D 25/2054 105/422 |
| 4,082,331 | A * | 4/1978 | Kennedy | E05C 3/14 292/128 |
| 4,118,894 | A * | 10/1978 | Kennedy | E21F 17/12 49/402 |
| 4,194,330 | A * | 3/1980 | Smith | B21D 13/045 52/177 |
| 4,267,954 | A * | 5/1981 | Smith | B21D 13/045 228/173.7 |
| 4,373,294 | A * | 2/1983 | Kennedy | E21F 17/12 292/228 |

(Continued)

FOREIGN PATENT DOCUMENTS

EP 1 808 546 A1 7/2007

*Primary Examiner* — Brian Glessner
*Assistant Examiner* — Gisele Ford
(74) *Attorney, Agent, or Firm* — Senniger Powers LLP

(57) ABSTRACT

A mine ventilation structure is disclosed. The structure comprises a deck including a plurality of elongate sheet metal panels. Each panel is generally of inverted channel shape in transverse cross-section, having a top web and first and second sides extending down from the top web. The panels are connected by tongue-and-groove connections between adjacent sides of adjacent panels. A mine ventilation deck panel of desired construction is also disclosed.

19 Claims, 10 Drawing Sheets

(56) References Cited

U.S. PATENT DOCUMENTS 4,478,535 A * 10/1984 Kennedy ..... E21F 17/103 405/132
4,483,642 A * 11/1984 Kennedy ..... E21F 17/103 405/132
4,484,837 A * 11/1984 Kennedy ..... E21F 17/103 405/132
4,547,094 A * 10/1985 Kennedy ..... E21F 1/145 405/132
4,695,035 A * 9/1987 Kennedy ..... E21F 17/103 254/133 R
4,820,081 A * 4/1989 Kennedy ..... E21F 17/103 405/132
4,911,577 A * 3/1990 Kennedy ..... E21F 1/10 405/150.1
4,915,540 A * 4/1990 Kennedy ..... E21F 17/103 188/371
5,167,474 A * 12/1992 Kennedy ..... E21D 11/102 405/132
5,168,667 A * 12/1992 Kennedy ..... E05C 3/042 292/204
5,174,682 A * 12/1992 Whitfield ..... E21F 1/14 405/132
5,222,838 A * 6/1993 Kennedy ..... E05F 5/12 405/132
5,240,349 A * 8/1993 Kennedy ..... E05F 5/12 405/132
5,412,916 A * 5/1995 Kennedy ..... E21F 1/14 405/132
5,466,187 A 11/1995 Kennedy et al.
5,661,937 A * 9/1997 Doppler ..... E04B 5/02 52/408
5,879,231 A * 3/1999 Sisk ..... E21F 1/14 405/132
6,032,986 A * 3/2000 Kennedy ..... E05C 3/162 292/196
6,129,483 A * 10/2000 Juracko ..... E21F 1/14 405/132
6,164,871 A * 12/2000 Kennedy ..... E21F 1/14 405/151
6,220,785 B1 * 4/2001 Kennedy ..... E21F 17/103 299/12
6,256,946 B1 * 7/2001 Kennedy ..... E04F 11/0255 52/183
6,264,549 B1 * 7/2001 Kennedy ..... E21F 1/14 405/153
6,379,084 B1 * 4/2002 Kennedy ..... E21F 1/145 248/354.4
6,394,707 B1 * 5/2002 Kennedy ..... E21D 15/18 248/354.2
6,402,611 B1 * 6/2002 Rohrbaugh ..... E21F 1/14 405/152
6,419,324 B1 * 7/2002 Kennedy ..... E21F 17/103 299/12
6,425,820 B1 * 7/2002 Kennedy ..... E21F 1/10 405/144
6,669,551 B2 12/2003 Kennedy et al.
6,901,708 B1 * 6/2005 Powers, III ..... E04B 1/08 52/86
6,938,372 B2 * 9/2005 Kennedy ..... E05F 15/53 16/49
6,973,881 B2 * 12/2005 Bianchi ..... B61D 17/10 105/422
7,690,862 B2 * 4/2010 Szekely ..... E01F 1/00 14/73
8,220,094 B2 * 7/2012 Kennedy ..... E01D 15/133 14/6
2003/0017005 A1 * 1/2003 Kennedy ..... E21F 17/103 405/132
2003/0079423 A1 * 5/2003 Kennedy ..... E21F 17/12 52/204.1
2003/0126798 A1 * 7/2003 Kennedy ..... E05F 15/53 49/334
2003/0129937 A1 * 7/2003 Kennedy ..... E21F 1/14 454/169
2003/0143942 A1 * 7/2003 Kennedy ..... E21F 1/145 454/169
2003/0147706 A1 * 8/2003 Kennedy ..... E21F 1/10 405/228
2004/0067730 A1 * 4/2004 Kennedy ..... E21F 1/14 454/169
2004/0266329 A1 * 12/2004 Kennedy ..... E21F 1/12 454/169
2005/0099020 A1 * 5/2005 Kennedy ..... E05B 63/22 292/332
2005/0101243 A1 * 5/2005 Kennedy ..... E21F 17/103 454/169
2006/0105695 A1 * 5/2006 Kennedy ..... E21F 1/14 454/169
2006/0172683 A1 * 8/2006 Kennedy ..... E21F 1/14 454/169
2007/0199244 A1 * 8/2007 Kennedy ..... E04H 9/12 49/70
2009/0279955 A1 * 11/2009 Kennedy ..... E21D 11/102 405/147
2011/0297057 A1 * 12/2011 Kennedy ..... E21D 21/00 109/79

* cited by examiner

MINE VENTILATION STRUCTURE AND A DECK PANEL FOR SUCH A STRUCTURE

CROSS REFERENCE TO RELATED APPLICATIONS

This application claims priority to U.S. Provisional application No. 61/987,743, filed May 2, 2014, the entire contents of which are hereby incorporated by reference.

FIELD OF THE INVENTION

This invention relates to mine ventilation structures, and more particularly to deck panels for making such structures.

BACKGROUND OF THE INVENTION

Reference may be made to our U.S. Pat. Nos. 5,466,187 and 6,669,551, assigned to Jack Kennedy Metal Products & Buildings, Inc. of Taylorville, Ill., for background on mine ventilation structures (e.g., overcasts and undercasts). Reference may also be made to the book titled "Practical Mine Ventilation" by William R. Kennedy, published in 1996 and 1999 by Intertec Publishing Corporation, for background on mine ventilation structures in general. The aforementioned patents and book are incorporated herein by reference.

The mine ventilation structures referred to in our U.S. Pat. Nos. 5,466,187 and 6,669,551 are fabricated from elongate deck panels of inverted channel shape in transverse cross section, each panel having a top formed by a web, opposite sides extending down from the web, and in-turned flanges at lower ends of the sides. The deck panels are placed alongside one another to form a deck for the ventilation structure. Achieving a tight fit between the sides of adjacent deck panels is difficult, often resulting in small gaps between adjacent panels through which air can escape, which is undesirable. There is a need, therefore, for an improved construction which eliminates this problem.

SUMMARY OF THE INVENTION

This invention is directed to a mine ventilation structure comprising a deck including a plurality of elongate sheet metal panels. Each panel is generally of inverted channel shape in transverse cross-section, the panel having a top web and first and second sides extending down from the top web. The panels extend alongside one another with the top webs of the panels forming a deck surface. There are tongue-and-groove connections between adjacent sides of adjacent panels. Each tongue-and-groove connection comprises a tongue formed in a first side of one panel received in a groove formed in a second side of an adjacent panel.

This invention is also directed to a mine ventilation deck panel. The deck panel is generally of inverted channel shape in transverse cross-section and comprises a top web, first and second sides extending down from the top web, a tongue on the first side for reception in a groove of a first adjacent deck panel alongside the first side wall, and a groove on the second side for receiving a tongue of a second adjacent deck panel alongside the second wall.

In addition, this invention is directed to a mine ventilation structure comprising a deck including a plurality of elongate sheet metal panels. Each panel is generally of inverted channel shape in transverse cross-section, the panel having a top web, first and second sides extending down from the top web, and in-turned flanges at lower ends of the first and second sides of the panel. The panels extend alongside one another with the top webs of the panels forming a deck surface. There are tongue-and-groove connections between adjacent sides of adjacent panels. Each tongue-and-groove connection comprises a tongue formed in a first side of one panel received in a groove formed in a second side of an adjacent panel. The tongue-and-groove connections are configured such that a portion of a vertical component of a vertical load placed on the deck is changed to a horizontal component for reducing stress resulting from the vertical load on the in-turned flanges of at least one panel. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
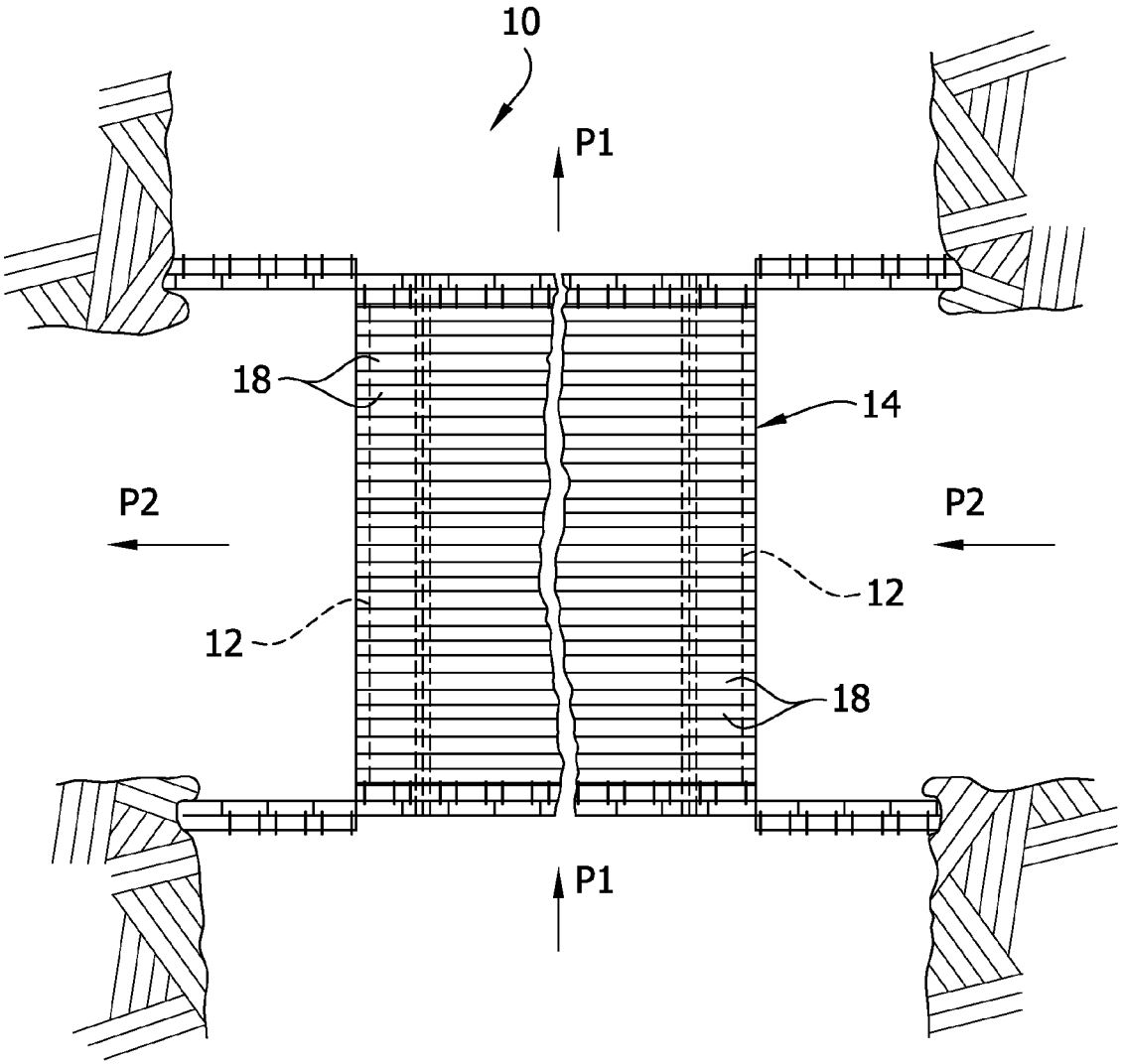
FIG. 1 is a top plan of a mine ventilation structure of this invention.

Referring first to FIG. 1 of the drawings, a mine ventilation structure of this invention, designated in its entirety by the reference numeral 10, is shown to comprise a tunnel-forming overcast having generally parallel spaced-apart side walls 12 and a deck, generally designated 14, spanning the side walls and constituting the roof of the tunnel and the floor of a passage over the tunnel. The overcast 10 is installed at the intersection of two passageways P1, P2 in a mine to maintain the air flowing through the two passageways separate. (In the embodiment shown in FIG. 1, the airflow in passageway P1 passes through the overcast 1 and the airflow in passageway P2 passes over the overcast.)

The deck 14 of the overcast 10 comprises a plurality of elongate sheet metal panels 18 extending between and bridging the side walls 12. To this extent, the overcast 10 corresponds to the overcast disclosed in our U.S. Pat. No. 5,466,187 and reference may be made thereto for detail, but it differs therefrom in that the panels 18 have tongue-and-groove connections, as will described. Desirably, the panels are made of sheet metal (e.g., 14-gauge sheet having a thickness of 0.079 in.).

Figure 2:
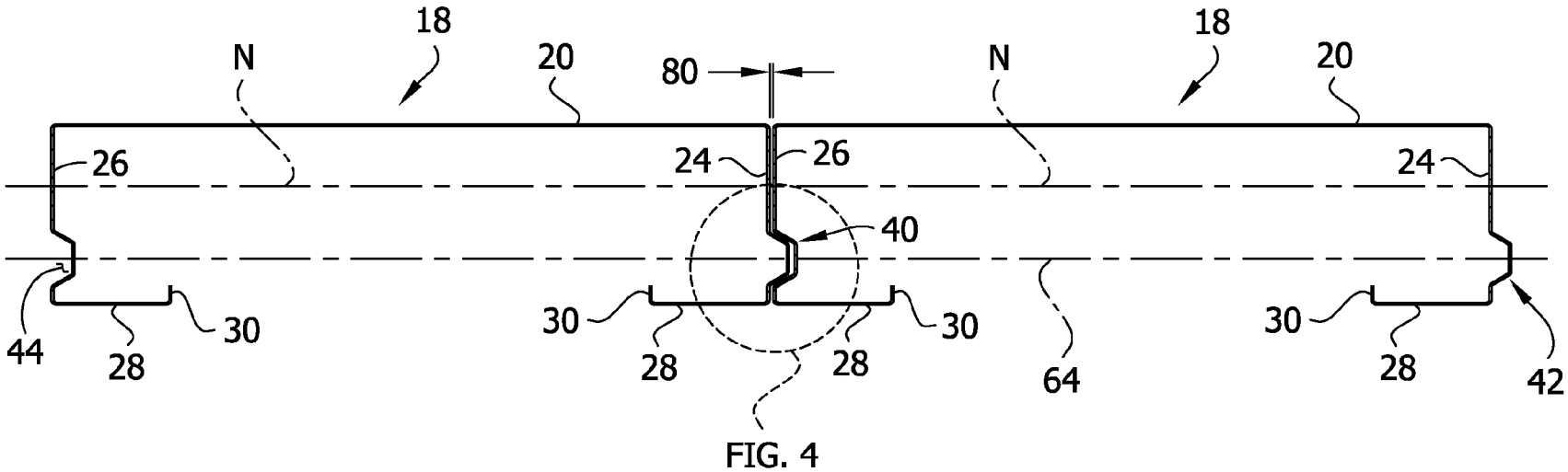
FIG. 2 is an enlarged transverse section of the mine ventilation structure showing several deck panels connected by tongue-and-groove connections.
Figure 3:
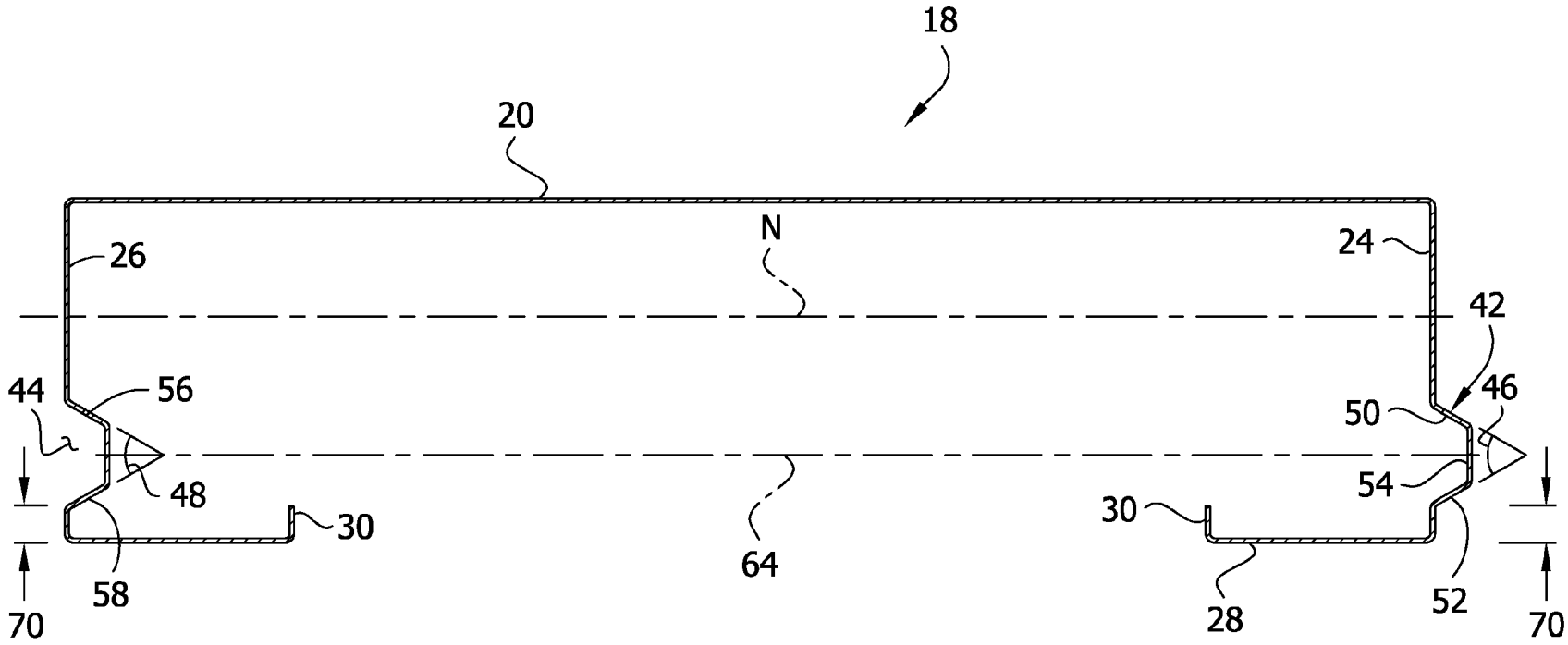
FIG. 3 is an enlarged transverse section of one of the deck panels showing a tongue and groove formed in respective sides of the panel.

Referring to FIGS. 2 and 3, each panel 18 is generally of inverted channel shape in transverse cross-section, having a top web 20, first and second sides 24, 26 extending generally vertically down from the web, and in-turned generally horizontal flanges 28 at the lower ends of the first and second sides. The flanges 28 have upturned free edges 30. In this embodiment, the top web 20 is substantially flat and lies in a generally horizontal plane, but it will be understood that the web may have other configurations, such as the indented configuration disclosed in our U.S. Pat. No. 6,669,551. The panels 18 extend between the tunnel side walls 12 alongside one another (i.e., in side-by-side relation) with the sides 24 of adjacent panels closely adjacent one with another and the flat horizontal areas presented by the top webs 20 in generally co-planar relation and forming a walking surface. Tie bars and wire ties (not shown) may be used as described in U.S. Pat. No. 5,466,187 to secure the panels 18 in place. Each panel 18 has a neutral axis N which, in this embodiment, is at a level approximating one-half of the panel depth. (The neutral axis is an axis in the cross section along which there are no longitudinal stresses or strains. When the panel is loaded, all fibers on one side of the neutral axis are in a state of tension, while those on the opposite side are in compression.) The neutral axis N may be at different levels for panels having different transverse cross-sectional configurations.

As noted above, the panels 18 are connected by tongue-and-groove connections, each of which is generally designated 40 in FIG. 2. Thus, the first side 24 of each panel 18 is formed with a tongue 42 and the second side 26 of each panel is formed with a groove 44, the tongue 42 of one panel being received in the groove 44 of an adjacent panel to form one of the tongue-and-groove connections 40. Desirably, as illustrated in FIG. 3, each tongue 42 comprises upper and lower walls 50, 52 projecting outward away from the first side 24 of each panel from an inner end of the tongue to an outer end of the tongue defined by a generally vertical end wall 54. It will be understood that the end wall 54 may have other shapes (e.g., rounded, concave, or slanted). Alternatively, the tongue 42 may be a vee-tongue with the upper and lower walls meeting at a pointed juncture. Similarly, each groove 44 comprises (is defined by) upper and lower walls 56, 58 extending inward from the second side 26 of each panel from an outer end of the groove to an inner end of the groove defined by a generally vertical end wall 60. It will be understood that like the tongue 42, the end wall 60 of the groove may have other shapes (e.g., rounded, concave, or slanted). Alternatively, the groove 42 may be a V-groove with the upper and lower walls 56, 58 meeting at a pointed juncture. In any event, the tongue 42 of one panel 18 is configured for a relatively close interference fit in the groove 44 of an adjacent panel. The tongue 42 and groove 44 of each panel have a common central axis 64 extending transversely of the panel. Desirably, this axis 64 is common across all of the tongue-and-groove connections 40 of the deck 14.

Desirably, the tongue 42 and groove 44 of each connection 40 are tapered toward the outer (free) end of the tongue and the inner (closed) end of the groove. In particular, the tongue 42 tapers toward the outer end of the tongue at a tongue taper angle 46 which, as shown in FIG. 3, is the included angle between the upper and lower walls 50, 52 of the tongue 42, either or both of which can be sloped relative to the central axis 64. Desirably, as in the illustrated embodiment, both the upper and lower walls 50, 52 of the tongue 42 slope at substantially the same angle relative to the central axis 64. That is, the tongue 42 is substantially symmetric about the central axis 64. Similarly, the groove 44 tapers toward the inner end of the groove at a groove taper angle 48 which, as shown in FIG. 3, is the included angle between the upper and lower walls 56, 58 of the groove 44, either or both of which can be sloped relative to the central axis 64. Desirably, as in the illustrated embodiment, both the upper and lower walls 56, 58 of the groove 44 slope at substantially the same angle relative to the axis 64. That is, the groove 44 is substantially symmetric about the central axis 64. In the illustrated embodiment, the tongue taper angle 46 and the groove taper angle 48 are substantially the same, but they may be different. For example, the tongue taper angle 46 may be greater than the groove taper angle 48.

The taper angle 46, 48 of the tongue-and-groove connections 40 effectively changes a portion of the vertical component of a vertical load on the deck 14 to a horizontal component. This change is advantageous because the decreased vertical component of the load reduces the stress on the in-turned panel flanges 28, which may be the weakest part of the deck structure.

The appropriate taper angles 46, 48 for any particular deck are determined by how much of the vertical load on the deck is to be transferred to the horizontal plane, which will vary according to material strength, lateral resistance, and other factors. For example, if the deck overall is more resistant to individual deck panels 18 sliding apart and/or if the sides 24, 26 of the deck panels are stronger (e.g., thicker, higher yield material, etc.), the tongue taper angle 46 and the groove taper angle 48 can be greater. In most situations, the tongue taper angle 46 and the groove taper angle 48 will be in the range of about 60-120 degrees, but this range is only exemplary.

In other embodiments, the tongue 42 and groove 44 of each connection are not tapered.

Desirably, the common central axis 64 of the tongue 42 and groove 44 of each panel 18 is located below the neutral axis N of the panel. Even more desirably, the entire tongue 42 of each panel and the entire groove 44 of each panel are located below the neutral axis of the panel, such that the tongue and groove are closely adjacent the in-turned flanges 28 of the panel. By way of example but not limitation, the tongue 42 and groove 44 are positioned as close as possible to respective flanges 28, e.g., by a distance 70 in the range of 0.5-1.0 in. (see FIG. 3). Adding the additional horizontal structure defining the tongue 42 and groove 44 at a location below the neutral axis N reduces the stress on the flanges 28 and increases the load-bearing capacity of the deck panel 18.

It will be observed from the foregoing that the tongue-and-groove connections 40 between the deck panels 18 provide advantages over prior designs. Importantly, the connections 40 allow a small gap or clearance 80 (FIG. 2) between adjacent panels 18 to facilitate assembly, while also effectively sealing the gap to prevent the escape of air from passageway P1 to passageway P2. To complement the seal provided by the connections 40, the portions of the gaps 80 above the connections 40 can be filled with a suitable sealant (e.g., rope caulk), or the gaps will fill over time with particulates (e.g., rock dust) from the surrounding mine environment. If the tongue-and-groove connections are tapered (like connections 40), the tapered connections provide for the transfer of some of the vertical load applied to one panel to adjacent panels, thus achieving a more equal distribution of the load over a greater area. Further, locating the tongue-and-groove connections below the neutral axis N of a panel 18 increases the strength of the in-turned flanges 28 (which might otherwise be the weak point of the panel), thus increasing the load-bearing capacity of the panel. In the illustrated embodiment, the tongue-and-groove connections 40 are both tapered and located below the neutral axis. In other embodiments, the tongue-and-groove connections may be tapered but not located below the neutral axis, or located below the neutral axis but not tapered.

Figure 4:
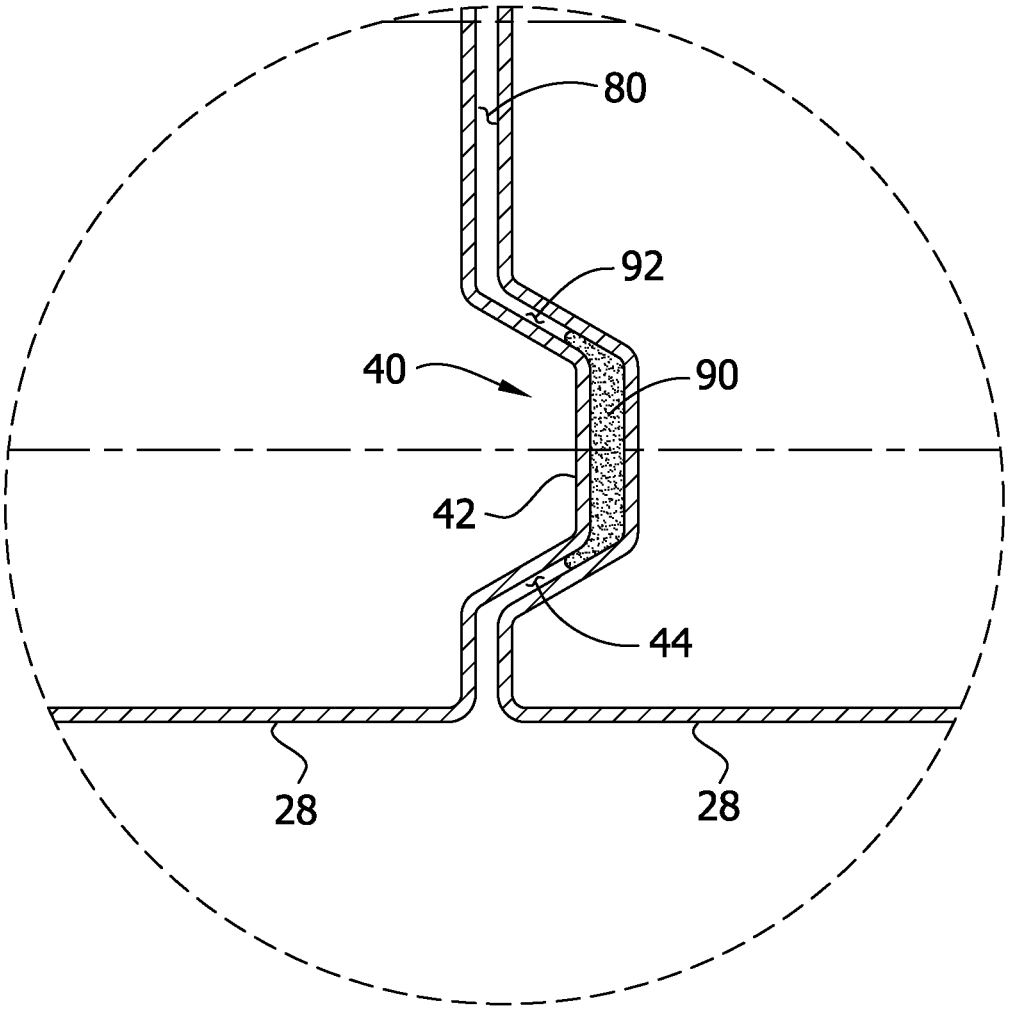
FIG. 4 is an enlarged view showing a sealant having a wedge fit in a tongue-and-groove connection.

FIG. 4 illustrates the optional use of a sealant 90 (e.g., caulk) to seal a space or gap 92 between the tongue 42 and groove 44 of a tongue-and-groove connection 40 between two deck panels 18. Desirably, the sealant is placed in the groove 44 before assembly of the two panels. As the tongue 42 of the mating panel is inserted into the groove 44, the tongue contacts the sealant and compresses it to seal the gap 92. In the case of a tapered tongue-and-groove connection 40, as illustrated in FIG. 4, compression of the sealant will cause it to deform and flow into the inclined regions of the gap 92 where it becomes tightly wedged in place.

Figure 5:
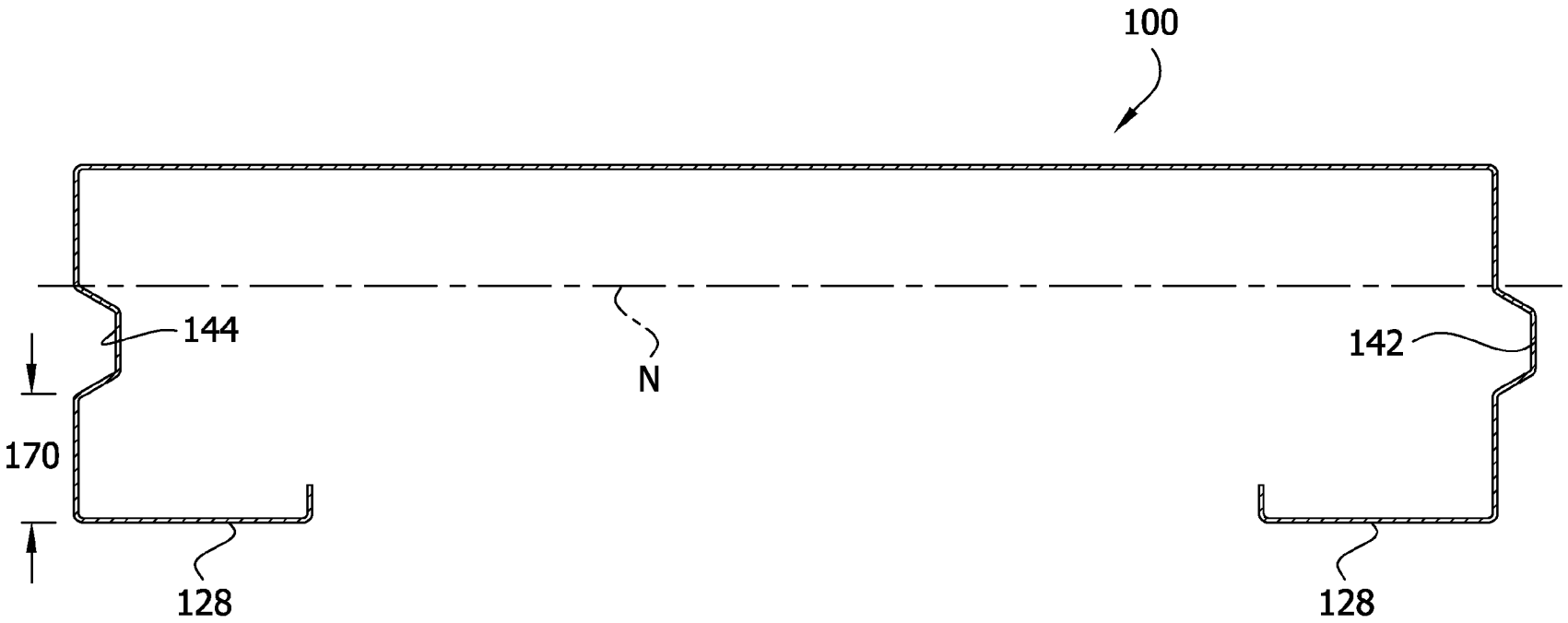
FIG. 5 is a transverse section showing a second embodiment of an alternative embodiment of a deck panel of this invention.

FIG. 5 illustrates a second embodiment of a deck panel of this invention, generally designated 100. The second deck panel is identical to the deck panel 10 of the first embodiment, except that the tongue 142 and groove 144 of the panel 100 are located closer to the neutral axis N of the panel and a greater distance 170 from the in-turned flanges 128.

Figure 6:
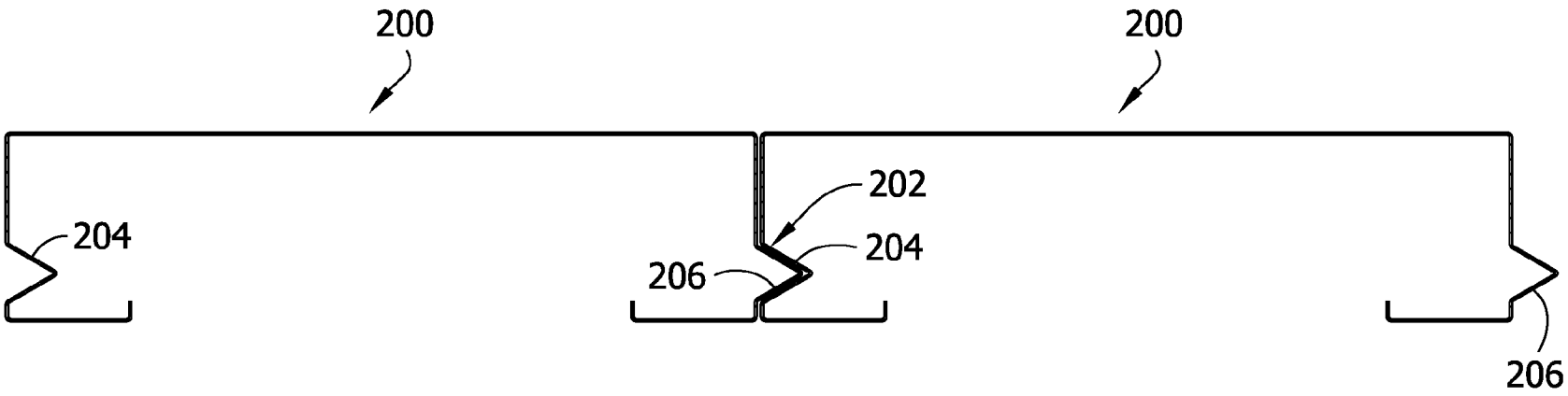
FIG. 6 is a transverse section of two deck panels having an alternative tongue-and-groove connection.

FIG. 6 illustrates a pair of deck panels 200 connected by a tongue-and-groove connection 202 comprising a V-shaped tongue 204 and a V-shaped groove 206.

The improved deck panels of this invention can be used to construct other types of mine structures, such as mine undercasts, bridge crossings (sometimes referred to as "bridgecasts"), and belt crossings.

The tongue 42 and groove 44 are formed in respective sides 24, 26 of a panel 18 by any suitable means, such as by a pressing (stamping) operation, or by extrusion, or by any other method.

Figure 7:
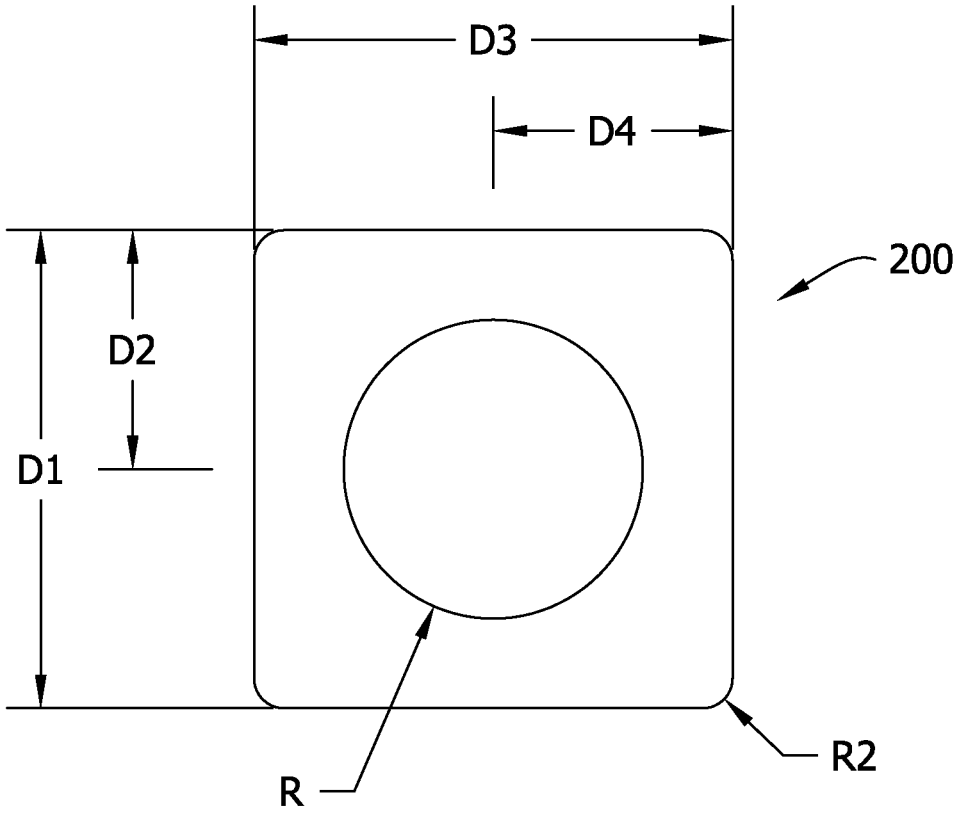
FIG. 7 is a cross-sectional view of one embodiment of a tubular rubber seal for sealing a tongue-and-groove connection between two panels.
Figure 8:
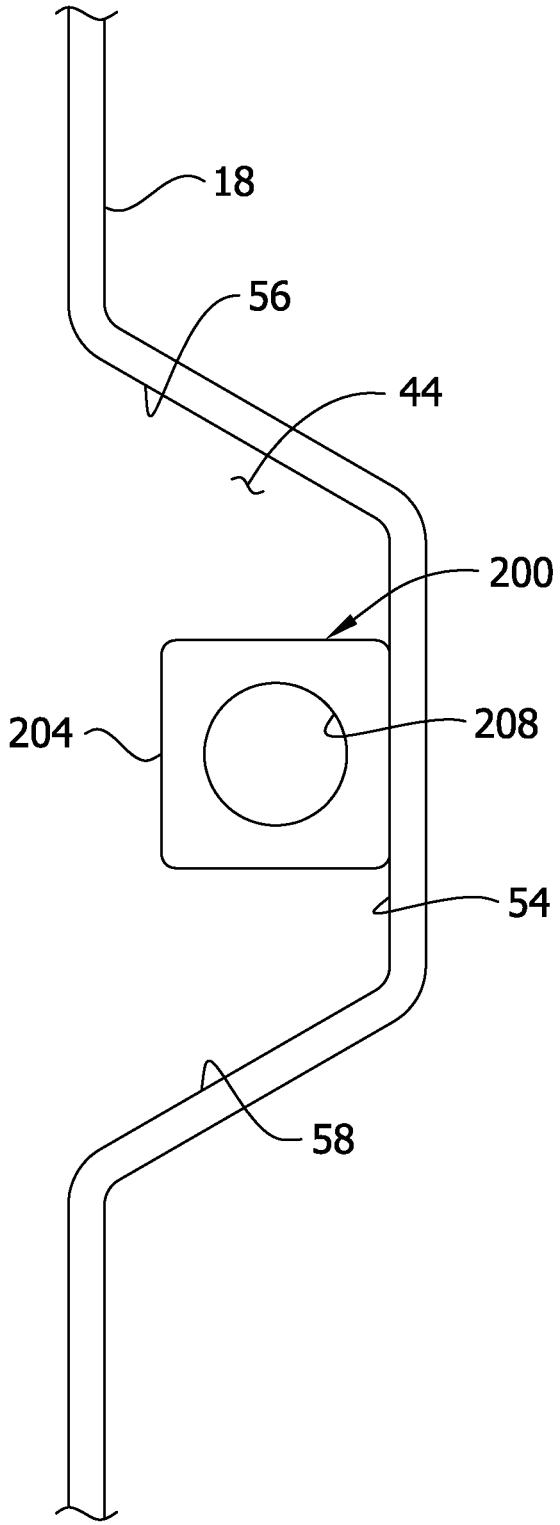
FIG. 8 is an enlarged view showing the seal of FIG. 7 secured in a groove of a panel.
Figure 9:
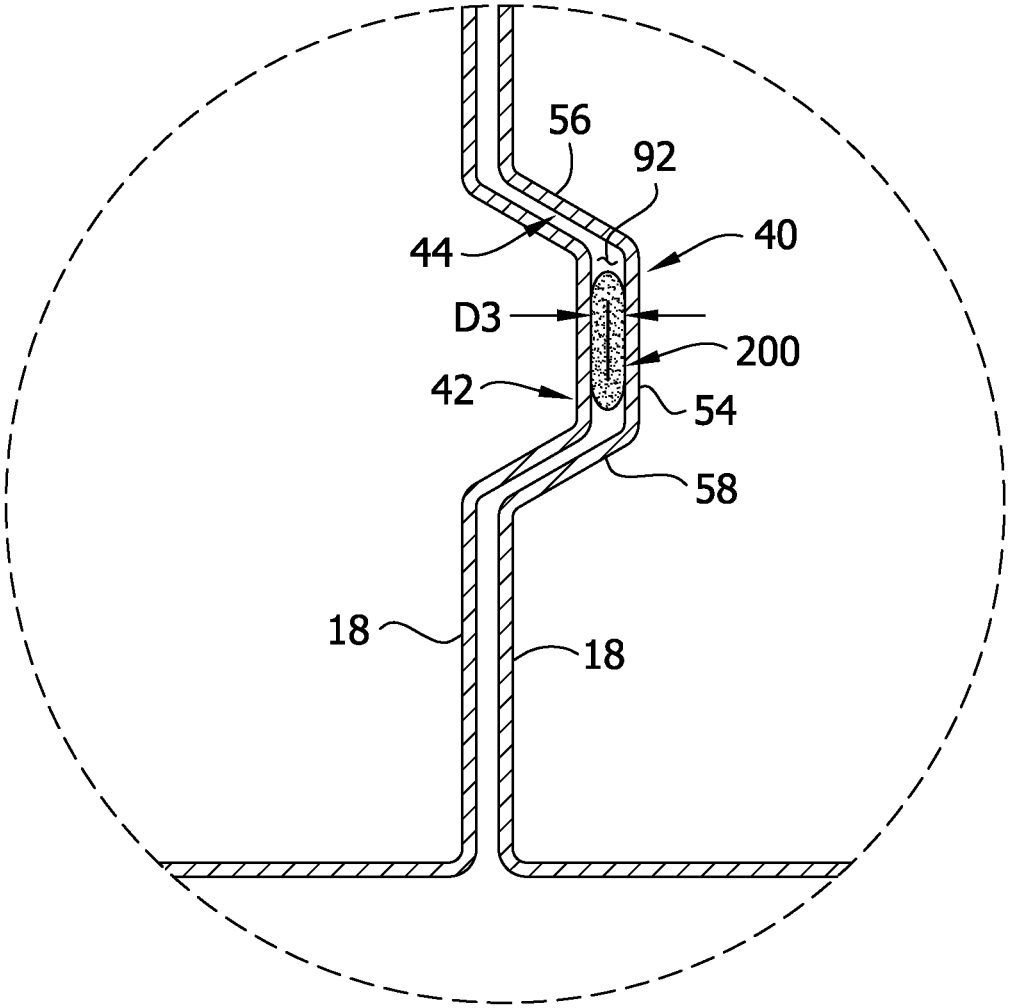
FIG. 9 is an enlarged view showing the seal of FIG. 8 compressed in a tongue-and-groove connection between two panels.

FIGS. 7-9 illustrate an alternative seal 200 for sealing the gap 92 between the tongue 42 and groove 44 of a tongue-and-groove connection 40 between two deck panels 18. Desirably, the seal 200 is placed in the groove 244 before assembly of the two panels.

In the embodiment of FIGS. 7-9 the seal 200 comprises an elongate member (also designated 200) including a hollow tubular body 204 defining an interior space 208. The tubular body 204 is of a resilient material, such as rubber for example. It may be installed in the groove 44 of one panel 18 and secured in place in the groove by a suitable adhesive, for example. As illustrated in FIG. 8, the body 204 is secured to the end wall 54 of the groove 44. In the absence of an end wall, the body 204 may be secured to the upper wall 56 and/or lower wall 58 of the groove 44. Alternatively, but less desirably, the body 204 may be secured to the tongue 42 of the tongue-and-groove connection 40. In any event, upon assembly of the two panels 218, as shown in FIG. 9, the resilient hollow body compresses and deforms to provide a tight seal between the two panels 18.

Referring to FIG. 7, the tubular body 204 has a generally square cross-sectional shape and defines a generally circular interior space 208 having suitable dimensions. By way of example but not limitation, the body 204 may have the following exemplary dimensions when used in a tongue-and-groove connection 40 in which the gap 92 between the panels 18 is about ⅛ in. and the end wall 54 of the groove 44 has a height of about ⅞ in.: D1=0.5 in.; D2=0.25 in.; D3=0.5 in.; D4=0.25 in.; R=0.315 in.; and R2=0.03 in. These dimensions will vary depending on such factors as the size and shape of the tongue-and-groove connection 40.

In one embodiment, the body 204 is made of underground rubber suitable for mining environments and has a chemical composition consistent with standard ASTM D1056-00 2C4 B2 Z1. By way of example but not limitation, the rubber used is neoprene. The body 204 has suitable mechanical properties, such as, for example, a density of 37±3 pcf according to ASTM D792; a compression deflection of 13-17 psi according to ASTM D 1056; a water absorption of less than or equal to 5% according to ASTM D 1056; a compression set of less than or equal to 25% according to ASTM D 1056 Suffix B2; a heat aged compression deflection of ±30% according to ASTM D 1056; a fluid immersion of less than or equal to 150% according to ASTM D 1056; and a modulus of elasticity of about 145. Desirably, the body 204 is flame resistant and has a flame spread index of less than 25 according to the ASTM E-162 test, such that the body has sufficient structure to block air flow even after it has been subjected to combustion temperatures and "burned up." That is, after the seal is burned, and until the seal is disturbed, the structure (ash) of the body 204 maintains substantially the same dimensions as the original rubber. As a result, the seal 200 cannot be burned out of the tongue-and-groove connection 40. Rubber seals having other mechanical properties are within the scope of this invention.

Referring to FIG. 9, the body 204 is compressed in the tongue-and-groove connection 40 when the panels 18 are assembled. The body 204 may be compressed to any dimension less than its original unstressed dimension to provide sealing ability. In one embodiment, the D3 dimension of the body is reduced from 0.5 in. down to about 0.19 in. when the panels 18 are properly positioned for full compression.

Figure 10:
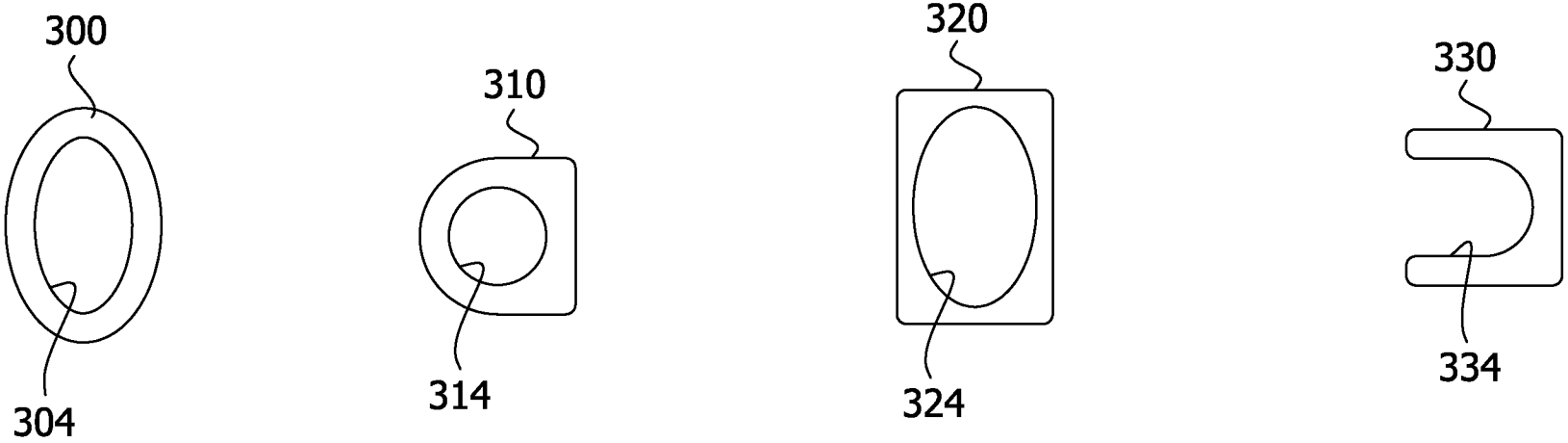
FIG. 10 is a view showing alternative embodiments of a rubber seal.

The hollow body 204 of the elongate seal 200 may have a variety of cross sectional shapes within the scope of this invention. FIG. 10 illustrates some of these different cross sectional shapes, including a hollow elliptical shape 300 defining an elliptical interior space 304, a hollow reverse D shape 310 defining a circular interior space 314, a hollow rectangular shape 320 defining an elliptical interior space 324, and a hollow channel shape 330 defining a U-shaped interior space 334. Other cross sectional shapes are within the scope of this invention.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions without departing from the scope of the invention, it is intended that all matter contained in the above description and shown in the accompanying figures shall be interpreted as illustrative and not in a limiting sense.

What is claimed is:

1. A mine ventilation structure comprising a deck including a plurality of elongate sheet metal panels, each panel being generally of inverted channel shape in transverse cross-section, the panel having a top web and first and second sides extending down from the top web, the panels extending alongside one another and the top webs of the panels forming a deck surface, tongue-and-groove connections between adjacent sides of adjacent panels, each tongue-and-groove connection comprising a tongue formed in a first side of one panel received in a groove formed in a second side of an adjacent panel to effect a transfer of a load on the deck from the one panel to the adjacent panel, wherein at least one of the tongue-and-groove connections is a tapered tongue-and-groove connection, and wherein the tongue of the at least one tapered tongue-and-groove connection tapers toward an outer end of the tongue at a tongue taper angle in the range of about 60-120 degrees.

2. The mine ventilation structure of claim 1, wherein the groove of the at least one tapered tongue-and-groove connection tapers toward an inner end of the groove at a groove taper angle substantially the same as the tongue taper angle.

3. The mine ventilation structure of claim 1, wherein a common central axis of the tongue and groove of each panel of said plurality of panels is located below a neutral axis of the panel.

4. The mine ventilation structure of claim 3, wherein each panel of said plurality of panels further comprises in-turned flanges at lower ends of the first and second sides of the panel, and wherein the tongue and groove of the panel are located closely adjacent within 0.5-1.0 in. of respective in-turned flanges.

5. The mine ventilation structure of claim 1, wherein each panel is made of sheet metal, wherein the tongue comprises upper and lower walls projecting outward from the first side of the panel from an inner end of the tongue to a tongue end wall at an outer end of the tongue, and wherein the groove comprises upper and lower walls extending inward from the second side of the panel from an open outer end of the groove to a groove end wall at an inner end of the groove.

6. The mine ventilation structure of claim 1, further comprising a sealant positioned in a gap between walls of the tongue and groove of the tapered tongue-and-groove connection.

7. The mine ventilation structure of claim 6, wherein the sealant comprises an elongate member of resilient material.

8. A mine ventilation structure comprising a deck including a plurality of elongate sheet metal panels, each panel being generally of inverted channel shape in transverse cross-section, the panel having a top web and first and second sides extending down from the top web, the panels extending alongside one another and the top webs of the panels forming a deck surface, tongue-and-groove connections between adjacent sides of adjacent panels, each to connection comprising a tongue formed in a first side of one panel received in a groove formed in a second side of an adjacent panel, a sealant positioned in a gap between walls of the tongue and groove of the tongue-and-groove connection, the sealant comprising an elongate member of resilient material, and wherein the elongate member comprises a hollow body of rubber.

9. The mine ventilation structure of claim 8, wherein the hollow body is tubular.

10. The mine ventilation structure of claim 8, wherein the hollow body is adhesively secured to an end wall of the groove of the tongue-and-groove connection.

11. A plurality of mine ventilation deck panels, each deck panel of said plurality of deck panels being generally of inverted channel shape in transverse cross-section and comprising a top web, first and second sides extending down from the top web, a tongue on the first side for reception in a groove of a first adjacent deck panel alongside the first side, a groove in the second side for receiving a tongue of a second adjacent deck panel alongside the second side, wherein each deck panel of the plurality of deck panels is free of any structure preventing the reception of the tongue of the deck panel in the groove of another deck panel of the plurality of deck panels, and wherein the tongue tapers toward an outer end of the tongue at a tongue angle of about 60-120 degrees.

12. The mine ventilation deck panels of claim 11, wherein the tongue and groove are tapered.

13. The mine ventilation deck panels of claim 12, wherein the groove has a groove taper angle substantially the same as the tongue taper angle.

14. The mine ventilation deck panels of claim 11, wherein the tongue and groove are located below a neutral axis of the deck panel.

15. The mine ventilation deck panels of claim 14, wherein each deck panel of the plurality of deck panels further comprises in-turned flanges at lower ends of the first and second sides of the deck panel, and wherein the tongue and groove of the panel are located closely adjacent respective in-turned flanges.

16. The mine ventilation deck panels of claim 11, wherein the tongue and groove are located below a neutral axis of the deck panel.

17. The mine ventilation deck panels of claim 16, wherein each deck panel of the plurality of deck panels further comprises in-turned flanges at lower ends of the first and second sides of the deck panel, and wherein the tongue and groove of the deck panel are located closely adjacent within 0.5-1.0 in. respective in-turned flanges.

18. The mine ventilation deck panels of claim 11, wherein each deck panel of the plurality of deck panels is made of sheet metal, wherein the tongue comprises upper and lower walls projecting outward from the first side of the deck panel to a tongue end wall, and the groove comprises upper and lower walls extending inward from said second side of the deck panel to a groove end wall.

19. A mine ventilation structure comprising a deck including a plurality of elongate sheet metal panels, each panel being generally of inverted channel shape in transverse cross-section, the panel having a top web, first and second sides extending down from the top web, and in-turned flanges at lower ends of the first and second sides of the panel, the panels extending alongside one another and the top webs of the panels forming a deck surface, tongue-and-groove connections between adjacent sides of adjacent panels, each tongue-and-groove connection comprising a tongue formed in a first side of one panel received in a groove formed in a second side of an adjacent panel, wherein each panel further comprises in-turned flanges at lower ends of the first and second sides of the panel, and wherein the tongue and groove of said tongue-and-groove connection are located closely adjacent within 0.5-1.0 in. of respective in-turned flanges.

* * * * *